US005370210A

United States Patent [19]

Ibarrola et al.

[11] Patent Number: 5,370,210

[45] Date of Patent: Dec. 6, 1994

[54] DEVICE FOR OBTAINING THE MECHANICAL CHARACTERISTICS OF COINS

[75] Inventors: Jesus E. Ibarrola; Jose L. Pina Insausti, both of Pamplona, Spain

[73] Assignee: Azkoyen Industrial S.A., Navarra, Spain

[21] Appl. No.: 35,389

[22] Filed: Mar. 23, 1993

[30] Foreign Application Priority Data

Mar. 24, 1992 [ES] Spain ..... 9200624

[51] Int. Cl.[5] ..... G07D 5/04

[52] U.S. Cl. ..... 194/317; 194/339

[58] Field of Search ..... 194/317, 327, 339

[56] References Cited

U.S. PATENT DOCUMENTS

| | | | |
|---|---|---|---|
| 1,625,979 | 4/1927 | Brinkerhoff . | |
| 3,415,256 | 12/1968 | Meloni . | |
| 3,712,441 | 1/1973 | Taylor . | |
| 3,878,711 | 4/1975 | Randolph . | |
| 4,105,105 | 8/1978 | Braum . | |
| 4,263,924 | 4/1981 | Johnson . | |
| 4,503,961 | 3/1985 | Chittleborough . | |
| 4,650,057 | 3/1987 | Koester . | |
| 4,690,263 | 9/1987 | Yokomori . | |
| 4,893,706 | 1/1990 | Ibarrola . | |
| 5,062,518 | 11/1991 | Chitty et al. | 194/317 |
| 5,067,604 | 11/1991 | Metcalf . | |
| 5,085,309 | 2/1992 | Adamson et al. . | |

FOREIGN PATENT DOCUMENTS

| | | | |
|---|---|---|---|
| 0000010 | 12/1978 | European Pat. Off. . | |
| 0184393 | 6/1986 | European Pat. Off. . | |
| 0246993 | 11/1987 | European Pat. Off. . | |
| 0323396 | 7/1989 | European Pat. Off. . | |
| 0360506 | 3/1990 | European Pat. Off. . | |
| 747958 | 6/1933 | France . | |
| 2293749 | 7/1976 | France . | |
| 603120 | 9/1934 | Germany . | |
| 2825094 | 12/1979 | Germany | 194/317 |
| 3009466 | 9/1981 | Germany . | |
| 3512579 | 10/1986 | Germany . | |
| 549841 | 12/1985 | Spain . | |
| 555181 | 5/1986 | Spain . | |
| 11006 | of 1892 | United Kingdom . | |
| 727581 | 4/1955 | United Kingdom . | |
| 1066389 | 4/1967 | United Kingdom . | |
| 1486519 | 9/1977 | United Kingdom . | |
| 2022897 | 12/1979 | United Kingdom . | |
| 2047936 | 12/1980 | United Kingdom . | |
| 2070307 | 9/1981 | United Kingdom . | |
| 2105893 | 3/1983 | United Kingdom . | |
| 2135094 | 8/1984 | United Kingdom . | |
| 8300400 | 2/1983 | WIPO . | |

*Primary Examiner*—F. J. Bartuska

*Attorney, Agent, or Firm*—Rothwell, Figg, Ernst & Kurz

[57] ABSTRACT

"Device for the obtaining of mechanical characteristics of coins", composed of a beam (1) that is embedded by at least one of its ends (2) and a flexible elastic by its displacement of coins through the length of the same. This beam (1) consist of an elongated plain strip of natural steel, with a lateral widening (4) at one of its extreme portions, which is introduced in an adjusted manner into a cavity encasement (6) formed in the selector, with said widening (4) remaining exteriorly retained by an anvil (8) that is fixed to the selector and pressured on the strip (1) towards the encasement, descanting the same in projecting with a certain longitudinal and transversal inclination.

4 Claims, 2 Drawing Sheets

DEVICE FOR OBTAINING THE MECHANICAL CHARACTERISTICS OF COINS

FIELD OF THE INVENTION

This invention relates to a device for obtaining the mechanical characteristics of coins, whose mechanism is intended for application to the coin selectors or verifiers utilized in machines which function by way of the introduction of one or more coins.

DESCRIPTION OF THE PRIOR ART

By way of Spanish patent no. 9002145 it is known to have a device that is composed of a flexible elastic element that is effected by the weight of the coin. The element consists of a beam which defines a rolling path on which the coins are moved, thereby provoking the deformation of said beam in a magnitude which depends on the weight of the coins and the respective position of the point or fixed points of the beam, same being defined by embodiments or end supports. The beam that composes the flexible elastic element also has a gauge for the received deformations, which gauge could consist of an extensometer or a displacement collector.

In accordance with the certificate of addition no. 9101787, presented in the above-mentioned patent, the beam which is composed of the flexible element includes an upper track which defines the course of the rolling of the coins and a lower track that serves as a means of anchoring or holding the combination of the beam to the body or selector device housing. These tracks form among themselves a certain angle, whose formation compels the collapsing of the piece which forms or adapts to the beam. Due to the high steely nature of the piece, the collapsing or doubling of the same provokes a breakage thereof. For this motive it is necessary to resort to forming the beam by means of two pieces of different qualities that are united together by means of soldering, one of these parts being of a ductile nature, so that it may be bent easily.

Still, the introduction of soldering and folding of the piece that will form the beam produces alterations in the geometry and behavior thereof, which alterations are transformed into errors in the subsequent measuring step.

SUMMARY OF THE INVENTION

The object of this invention is to develop a piece having a simple geometry and a system of assembling the same so that it acts as a flexible elastic beam, the functioning of which provides the ability to obtain measurements of great exactness.

In accordance with this invention, the piece that forms to the flexible elastic beam is composed of an elongated flat strip of a steel nature, and of small width in respect to its length. This piece presents in one of its extreme portions a laterally widened portion extending towards one side, while a notch or undercut extends from the widened portion towards the opposite side. The mentioned widened portion is introduced laterally in an adjustable manner in an encasement formed in the selector device. With the notch disposed such that it extends and remains directed towards the outside of the selector, an anvil or an exterior resistant part is fixed on said selector and pressures the widened portion of the flat strip towards its encasement such that said strip is oriented in cantilever fashion with a certain longitudinal inclination while descending transversely.

The mentioned strip may be of rectangular form with a substantial length in respect to the width, and the widened portion and notch are formed so as to extend from the longitudinal opposite edges, and away from one of the transverse edges, of the strip.

The configuration of the part that defines the elastic beam and its method of assembly is shown in greater detail with the aid of the attached drawings, wherein an example of a non-limiting embodiment is shown.

DETAILED DESCRIPTION OF THE DRAWINGS

Figure 1:
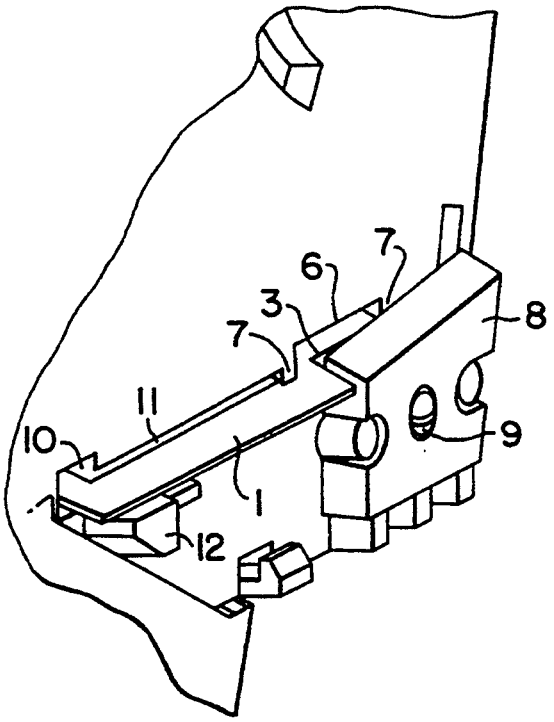
FIG. 1 is an interior perspective view of a selector in which the elastic beam according to the invention is mounted.

FIG. 1 is a perspective, view of the internal surface of the gate of a coin selector. In this gate is mounted part 1 which defines a flexible elastic beam on which the introduced coins will roll in the selector, thereby deforming this beam in accordance with the weight of the coin and its position at each moment.

Figure 6:
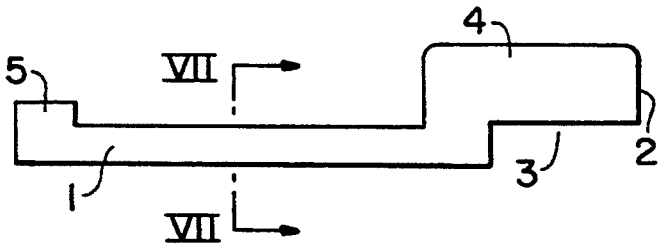
FIG. 6 is a plane view of the elastic beam according to the invention.
Figure 7:
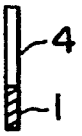
FIG. 7 is a transversal section, according to line VII—VII of FIG. 6.

Piece 1, as can be seen in FIGS. 6 and 7, is comprised of a rectangular strip of natural steel having a substantial length in respect to its width. In in one of the longitudinal edges of strip 1, starting from the transverse border 2, an end notch 3 is formed. Starting from the transverse border 2 along the opposite longitudinal edge a widened portion 4 is formed so as to be lo-planar with the strip 1. It the opposite end the strip presents a minor laterally widened portion 5.

Figure 2:
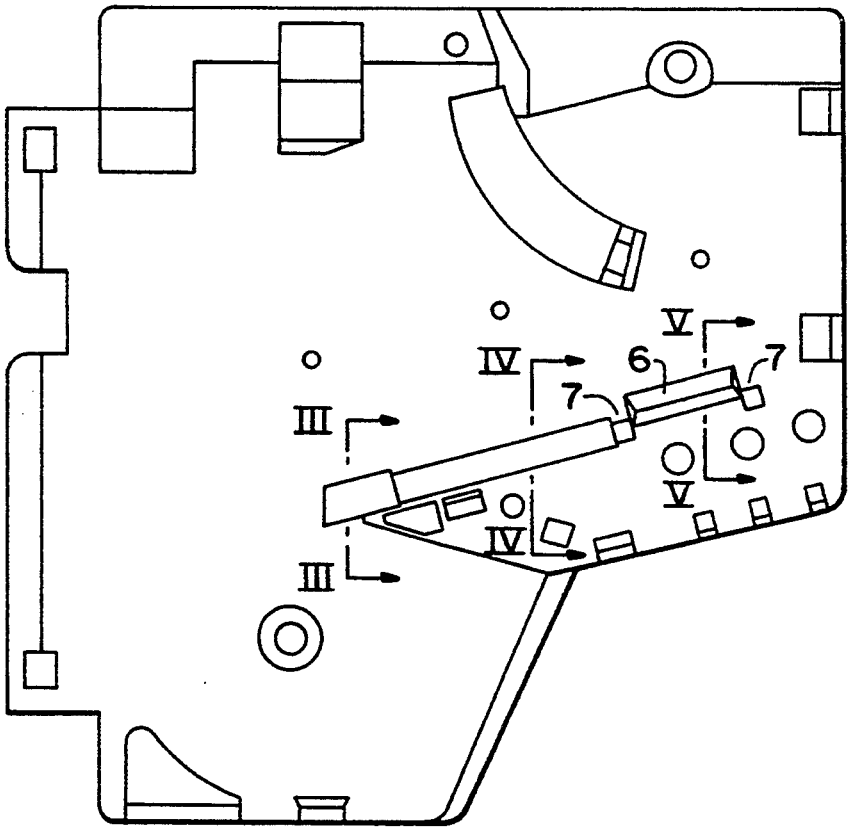
FIG. 2 is a frontal elevation view of the internal surface of the selector shown in FIG. 1, without the flexible beam disposed therein.
Figure 5:
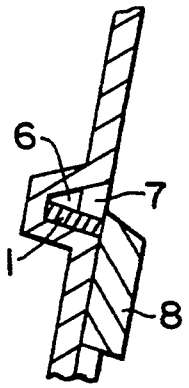

The selector gate, as can be appreciated in FIGS. 1 and 2, has a cavity 6 which is conformed to define an adjusted encasement which receives the widened portion 4 of the strip 1. This cavity 6 is of greater height than the thickness of strip 1 but is limited by end tracks 7 of a height coinciding with the thickness of the strip 1, such that the widened portion 4 of the strip remains flush and fixed exactly between the narrowing ends 7. As can be appreciated in FIG. 5, the strip 1 stays against the bottom of the cavity 6.

The end notch 3 remains directed towards the exterior of the device, and against same rests an anvil 8, consisting of a metallic piece which is fixed to the gate, for example with a screw 9. The anvil 8 rests on the outer edge of the undercut or notch 3, pushing the widened portion 4 towards the encasement 6.

With this assembly, the strip or beam 1 is oriented in cantilever fashion so as to be elastically deformed by the weight of the coin as a function of the position occupied in each moment by said coin on the beam.

The minor widened portion 5 stays in a second cavity 10 formed in the selector which cavity also has a longitudinal groove 11 in accord with the strip 1.

Figure 3:
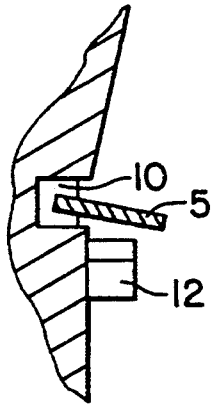
FIGS. 3, 4 and 5 are sections, on a larger scale, taken respectively, according to the cut away lines III—III, IV—IV and V—V of FIG. 2.

The maximum deformation magnitude or displacement of the cantilevered strip 1 remains limited by the edges of the second cavity 10 and by the top of lower member 12 (FIG. 3).

Figure 4:
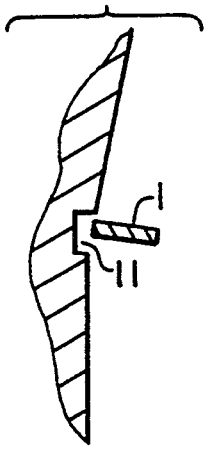

FIG. 3 shows how the minor widened portion 5 slightly penetrates the slot 10. FIG. 4 shows how the strip 1 lays parallel to the groove 11, without penetrating it.

Strip 1, as can be appreciated in the drawings, is oriented in cantilever fashion with a slight descending inclination in the longitudinal and transversal directions, in order to facilitate the rolling of the coins and the positioning of the same.

With the described assembly system, the strip or flexible elastic beam 1 adopts at all moments to the correct position, due to the action of the anvil 8 on the undercut 3 of said strip, without producing an deviation during any possible maintenance manipulations, for example to remove jammed coins.

It is apparent that the invention provides a piece or flexible elastic beam of simple geometry, whose assembly in the selector device is also effected in a simple manner, it being sufficient to merely introduce the laterally widened portion 4 in the corresponding encasement 6 and later place the anvil 8 that is fixed thereagainst by means of a screw 9.

We claim:

1. A coin selector device for obtaining the mechanical characteristics of coins, the device comprising:

a cavity which defines an encasement for receiving a flexible beam that defines a path for a rolling coin, the beam being deformed by the coin as it rolls along the beam with the device measuring the deformation of the beam caused by the coin;

the beam including an elongated strip of material having first and second opposite ends and a length which is greater than a width of said strip, the first end having a widened portion which extends laterally from the strip toward one side thereof, and a notch portion which extends into the strip from an opposite side thereof so as to be adjacent said widened portion; and wherein the elongated strip is positioned in the cavity of the device so that a portion of the strip projects from the device in cantilever fashion to receive a rolling coin, said cantilever portion of the strip being inclined laterally and longitudinally, and the widened portion of said strip being received in the encasement with an anvil member being fixed to the device so as to extend into the notch to force the widened portion of said strip toward the encasement.

2. A coin selector device according to claim 1, wherein the strip is formed of a flexible piece of steel.

3. A coin selector device according to claim 1, wherein the strip has a rectangular configuration, and said widened portion and said notch extend from the first end toward the second end, said widened portion extending a greater distance toward said second end so as to have a greater length than said notch.

4. A coin selector device according to claim 3, wherein the second end of the strip has a minor widened portion which is smaller than said widened portion and is received in the cavity of the device.

* * * * *

UNITED STATES PATENT AND TRADEMARK OFFICE

CERTIFICATE OF CORRECTION

PATENT NO. : 5,370,210

DATED : December 6, 1994

INVENTOR(S) : Jesus E. Ibarrola et al.

It is certified that error appears in the above-identified patent and that said Letters Patent is hereby corrected as shown below:

Col. 2, line 23, "plane" should be --plan--.

Col. 2, line 30, "perspective," should be --perspective--.

Col. 2, line 43, "lo-planar" should be --co-planar--.

Col. 2, line 44, "It" should be --At--.

Col. 3, line 15, "adopts" should be --adapts--.

Signed and Sealed this

Twenty-eight Day of February, 1995

*Attest:*

Bruce Lehman

BRUCE LEHMAN

*Attesting Officer*

*Commissioner of Patents and Trademarks*